US012385232B2

(12) United States Patent
Serrurier et al.

(10) Patent No.: US 12,385,232 B2
(45) Date of Patent: Aug. 12, 2025

(54) ADAPTER WITH THRU-HOLE AND RAIL

(71) Applicant: Caterpillar Inc., Peoria, IL (US)

(72) Inventors: Douglas C. Serrurier, Morton, IL (US); Eric T. Sinn, Tremont, IL (US); Jason Grant Jura, Tremont, IL (US); Corey Michael Wells, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 176 days.

(21) Appl. No.: 17/464,793

(22) Filed: Sep. 2, 2021

(65) Prior Publication Data

US 2023/0061737 A1 Mar. 2, 2023

(51) Int. Cl.
*E02F 9/28* (2006.01)

(52) U.S. Cl.
CPC ..... *E02F 9/2825* (2013.01); *E02F 9/2833* (2013.01); *E02F 9/2841* (2013.01); *E02F 9/2858* (2013.01)

(58) Field of Classification Search
CPC ..... E02F 9/2841; E02F 9/2825; E02F 9/2833; E02F 9/2858
See application file for complete search history.

(56) References Cited

U.S. PATENT DOCUMENTS 3,740,876 A 6/1973 Solokhin et al.
3,997,989 A * 12/1976 Stepe ..... F16B 21/186 37/459
4,096,653 A * 6/1978 Kaarlela ..... E02F 9/2841 37/457
4,823,486 A * 4/1989 Diekevers ..... E02F 9/2841 37/456
4,918,843 A * 4/1990 Kiesewetter ..... E02F 9/2841 267/141
5,918,391 A * 7/1999 Vinas Peya ..... E02F 9/2833 37/456
5,956,874 A * 9/1999 Ianello ..... E02F 9/2825 37/456
6,092,958 A * 7/2000 Gale ..... F16B 21/186 37/456
9,009,995 B2 * 4/2015 Freund ..... E02F 9/2825 37/456
2004/0060207 A1 * 4/2004 Livesay ..... E02F 9/2825 37/451
2004/0237354 A1 12/2004 Emrich
2005/0055853 A1 3/2005 Livesay et al.
2008/0184603 A1 * 8/2008 Pasqualini ..... E02F 9/2841 37/459
2012/0246982 A1 10/2012 Bentley
2019/0063044 A1 * 2/2019 Balan ..... E02F 9/2883
2020/0340218 A1 10/2020 Wells et al.

FOREIGN PATENT DOCUMENTS

CN 202214757 5/2012
CN 202214757 U * 5/2012 ..... E02F 9/2841
CN 108729497 A 11/2018
EP 2510160 10/2012
ES 2734910 B2 4/2020

* cited by examiner

*Primary Examiner* — Matthew Troutman
*Assistant Examiner* — Blake E Scoville

(57) ABSTRACT

A base includes a male portion including a first projection, and a second projection facing in a diametrically opposed manner to the first projection. A stepped bore extends from the first projection to the second projection that has a large diameter portion that is at least partially formed by the first projection.

16 Claims, 9 Drawing Sheets

ADAPTER WITH THRU-HOLE AND RAIL

TECHNICAL FIELD

The present disclosure relates to retaining mechanisms employed on work implement assemblies such as bucket assemblies used by earth moving, mining, construction equipment and the like for attaching a tip to an adapter of the work implement assembly. More specifically, the present disclosure relates to a retaining mechanism that uses a retainer pin assembly to attached the tip to the adapter and a rail to foolproof the type of tip that can be attached to the adapter.

BACKGROUND

Machines such as wheel loaders, excavators, and the like employ work implement assemblies including bucket assemblies, rakes, shears, etc. that have teeth or tips attached to them to help perform work on a material such as dirt, rock, sand, etc. For example, teeth or tips may be attached to a bucket assembly to help the bucket assembly to penetrate the ground, facilitating the scooping of the dirt into a bucket. Adapters are often attached to the work edges (e.g. the base edge, the side edge, etc.) of the bucket or other work implement so that different styles of teeth or tips may be attached to the work implement. Also, the tips or teeth may be replaced easily when worn by providing a retaining mechanism that is used to selectively hold the tip onto the adapter or to allow the tip be removed from the adapter.

U.S. Pat. No. 3,740,876 A discloses a tooth for a bucket that includes a base and a changeable cap. Provided on the base is a lug which is cross-shaped in its cross-section. Opposite faces of the support side edges of the lug of the base are made parallel with respect to the longitudinal axis of the tooth along the whole length of the lug, i.e., the edges have one and the same thickness along their whole length. The lug of the base has a through opening and a hole accommodating a slide block and an elastic member. Made in the changeable cap coaxially to the opening is a through opening. Inserted into the coaxial openings is a pin fixing the position of the changeable cap on the lug of the base.

However, the retaining clip in the '876 patent does not provide an non-load bearing foolproof feature to limit the type of tip attached to an adapter.

Similarly, U.S. Pat. No. 5,956,874 A discloses a tooth point mounted on the nose of an adapter. The tooth point is removably secured to the adapter by a locking pin held in place by a keeper. Bosses are provided on the tooth point that slide into grooves found on the nose of the adapter.

However, the tooth point of the '874 patent may not work with adapters in the field that do not have grooves on the nose of the adapter.

SUMMARY OF THE DISCLOSURE

An adapter assembly according to an embodiment of the present disclosure may comprise an adapter including a body that defines a longitudinal axis, a vertical axis that is perpendicular to the longitudinal axis, and a lateral axis that is perpendicular to the vertical axis, and the longitudinal axis. The body that has a nose portion including an aperture and a first rail disposed adjacent the aperture along the longitudinal axis. The first rail may extend laterally, and vertically from the nose portion.

An adapter according to an embodiment of the present disclosure may comprise a nose portion that defines an aperture, a first rail extending from the nose portion that is disposed adjacent to the aperture, and a second rail that is disposed adjacent to the aperture extending in a diametrically opposing manner as compared to the first rail. The first rail and the second rail may be differently configured.

A base according to an embodiment of the present disclosure may comprise a male portion including a first projection, and a second projection facing in a diametrically opposed manner to the first projection. A stepped bore may extend from the first projection to the second projection that has a large diameter portion that is at least partially formed by the first projection.

DETAILED DESCRIPTION

Figure 1:
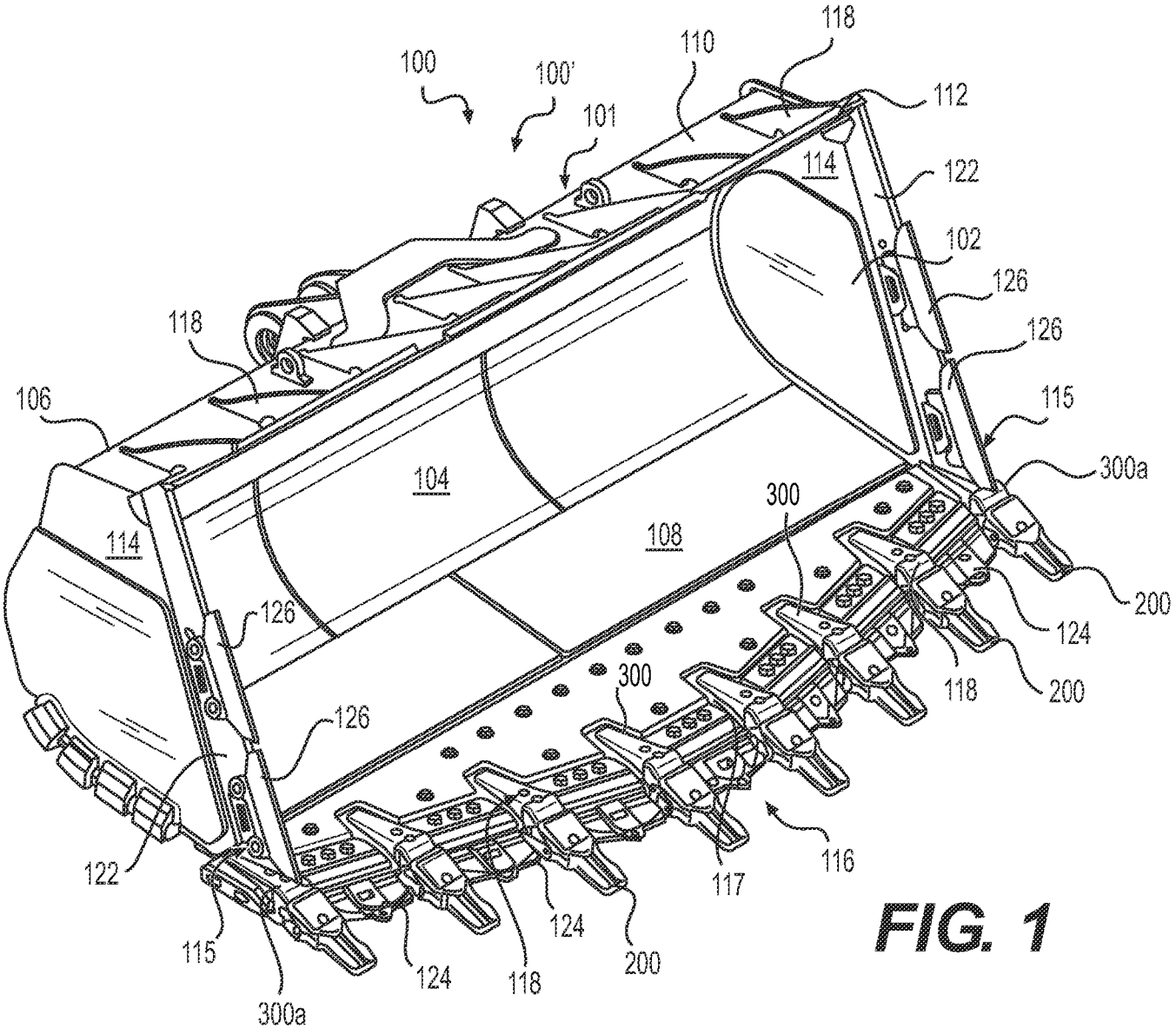
FIG. 1 is a perspective view of a work implement assembly such as a bucket assembly using tips, adapters, and retaining mechanisms with components configured according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function such as is often the case when geometry is mirrored about a plane of symmetry. For ease of explanation in this specification, letters or primes will often not be included herein but may be shown in the drawings to indicate duplications of features discussed within this written specification.

A work implement assembly using tips according to various embodiments of the present disclosure will now be discussed.

Starting with FIG. 1, the work implement assembly 100 may take the form of a bucket assembly 100' that may be used by a wheel loader and that includes an enclosure 101 that defines an opening 102 that communicates with a generally enclosed interior. Starting from the rear of the bucket assembly 100 as shown in FIG. 1, the bucket assembly 100 includes a curved shell profile 104, which is attached to a rear wall 106 at the top end of the shell 104. The other end of the shell is attached to the bottom plate 108 of the assembly 100. A top plate 110 is attached to the top end of the rear wall 106. The top plate 110 transitions to a spill guard 112 that is designed to funnel material into the interior of the bucket and prevent material from spilling out of the bucket. Reinforcing ribs 118 are provided that are attached to the top plate 110 and the spill guard 112, providing reinforcement for strength. Two substantially flat end plates 114 are attached to the side edges of the spill guard 112, top plate 110, rear wall 106, bottom plate 108 and shell 104.

A side edge assembly 115 is attached to each end plate 114 while a front edge assembly 116 is attached to the front edge of the bottom plate 108 of the bucket assembly 100. The front edge assembly 116 includes a base edge 117 that is attached to the bottom plate 108, a plurality of tip and adapter assemblies 118 attached to the base edge 117, and a plurality of tips 200 (may also be referred to as tools, teeth, wear members, etc.) with each one of the plurality of tips 200 being attached to one of the plurality of center adapters 300. Also, two corner adapters 300*a* are also attached to the base edge and the side edges 122 of the bucket assembly 100'. Tip 200 may also be attached to the corner adapters 300*a*.

Moreover, a plurality of base edge protectors 124 are also provided with each one of the base edge protectors 124 positioned between center adapters 300 and between a center adapter 300 and a corner adapter 300*a*. A side edge protector 126 is also provided that is attached to the side edge 122 proximate to a corner adapter 300*a*.

It is to be understood that the work implement assembly may take other forms other than a bucket assembly including rake assemblies, shear assemblies, etc. In addition, a differently configured bucket that is meant to be used by an excavator may also use various embodiments of a tip, retaining mechanism, adapter, spring, sleeve, adapter assembly, and tip and adapter assembly, etc. as will be discussed herein.

Figure 2:
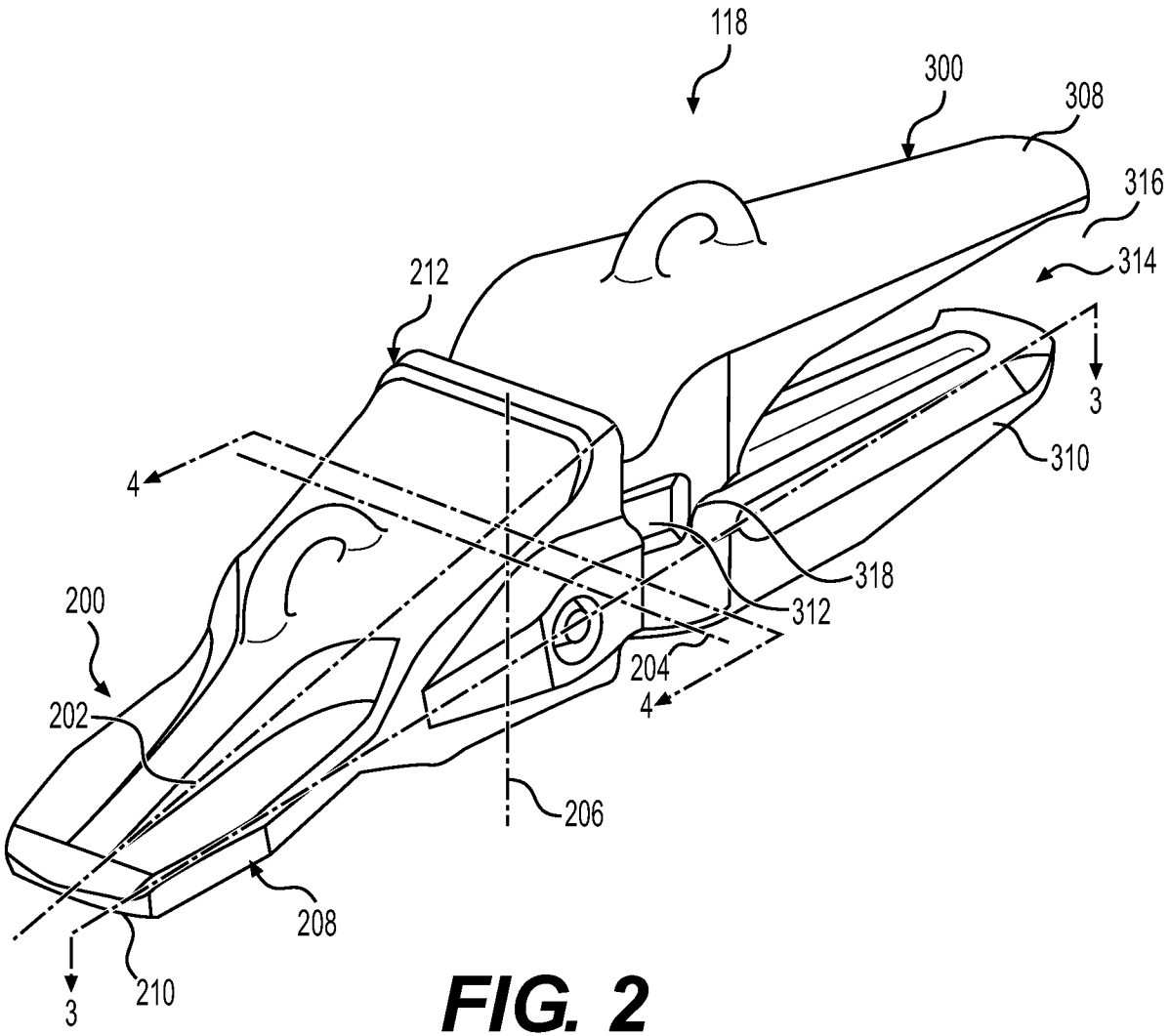
FIG. 2 is a perspective view of a tip and adapter assembly of FIG. 1, shown in isolation from the work implement assembly of FIG. 1.
Figure 3:
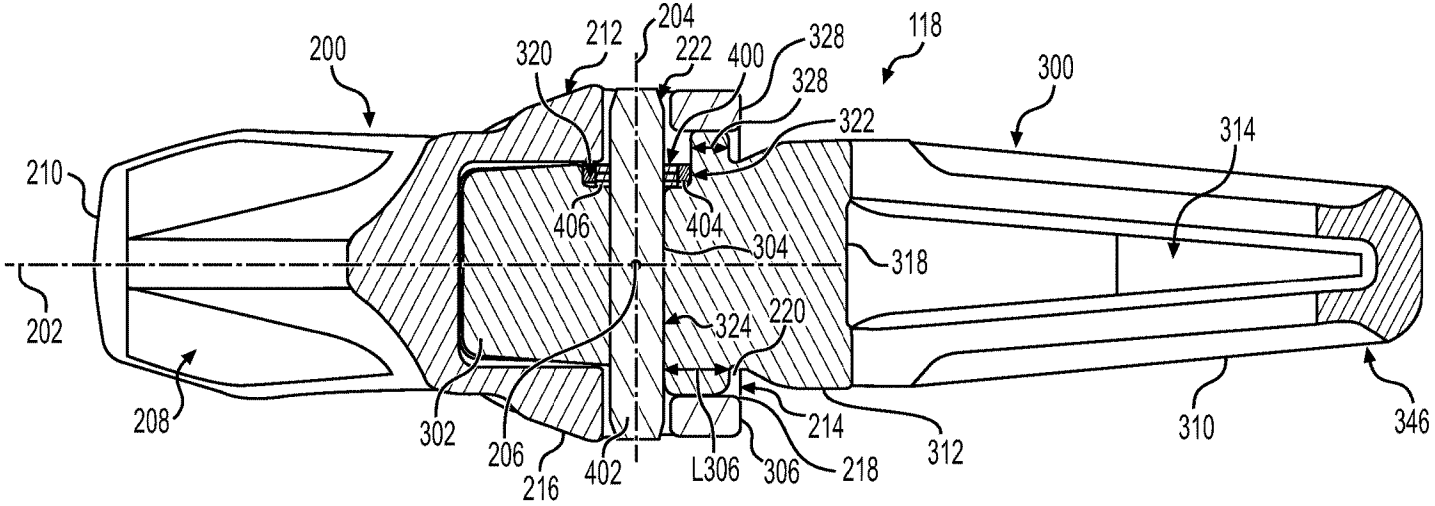
FIG. 3 is a top sectional view of the tip and adapter assembly of FIG. 2 taken along lines 3-3 thereof, showing a retaining mechanism and a pair rails adjacent to the retaining mechanism according to an embodiment of the present disclosure in a locked configuration.

Looking at FIGS. 2 and 3, a tip and adapter assembly 118 according to an embodiment of the present disclosure may comprise a tip 200 including a body that defines a longitudinal axis 202, a vertical axis 204 that is perpendicular to the longitudinal axis 202, and a lateral axis 206 that is perpendicular to the vertical axis 204, and the longitudinal axis 202. The tip may include a forward working portion 208 disposed along the longitudinal axis 202 including a closed end 210 (may not always be necessary), and a rear attachment portion 212 disposed along the longitudinal axis 202 including an open end 214 with an exterior surface 216, and an interior surface 218.

It is to be understood that the tip and adapter are designed to mate with each other, and therefore may share the same longitudinal axis, lateral axis, and vertical axis.

Figure 4:
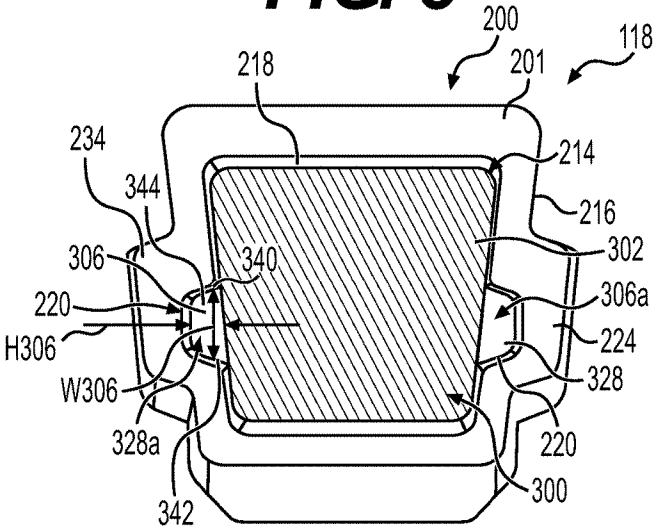
FIG. 4 is a rear sectional view of the tip and adapter assembly of FIG. 2 taken along lines 4-4 thereof.

Focusing on FIGS. 3 and 4, the assembly 118 may also include an adapter (e.g., a center adapter 300 is shown in detail but a corner adapter 300*a* as shown in FIG. 1 may be similarly constructed) including a body that has a nose portion 302 defining an aperture 304, and including a first rail 306 disposed adjacent the aperture 304 along the longitudinal axis 202 (may be disposed rearwardly of the aperture as shown, or forwardly, etc.). The first rail 306 may extend laterally, and vertically from the nose portion 302. At the same time, and the interior surface 218 of the tip 200 defines a rail receiving groove 220 with the first rail 306 disposed in the rail receiving groove 220. Two such grooves may be provided to receive two rails as shown, but not necessarily so. The tip 200 may further define a hole 222 that is aligned with the aperture 304 of the adapter 300 (e.g., collinear, concentric, etc.) for receiving a retaining mechanism 400 as will be described in more detail momentarily.

In FIG. 2, the adapter 300 may be provided with mounting structure such as a first leg 308, a second leg 310, and a throat portion 312 that connects the first leg 308 to the second leg 310, forming a slot 314 with an open end 316, and a closed end 318. Hence, the adapter may be attached to a lip or other edge of a work implement by sliding the legs over the edge so that the legs straddle the edge (thus defining a longitudinal axis, etc.). A retaining mechanism or welding, etc. may be used to hold the adapter onto the edge. Other types of mounting structure may be employed in other embodiments of the present disclosure.

Referring back to FIG. 3, the hole 222 of the tip, and the aperture 304 of the adapter may form a passage that extends laterally completely through the assembly 118, allowing a retaining pin 402 to pass completely through the assembly. This may not be the case for other embodiments of the present disclosure.

More specifically, the aperture 304 of the adapter 300 may take the form of a counterbore 320 (see also FIG. 6) with a large diameter portion 322, and a small diameter portion 324 that is in communication with the hole 222 of the tip 200. The retaining mechanism 400 may include a sleeve 404, and a spring 406 that are disposed in the counterbore 320. The spring 406 may be a coil washer type spring member that expands, allowing the pin to pass through until the spring falls into a notch on the side of the pin (and/or via friction), holding the pin in place against unintentional displacement. Other retaining mechanisms may be employed, etc.

Put another way, the pin 402 may engage the spring, being disposed in the large diameter portion 322 of the counterbore, the small diameter portion 324 of the counterbore, and the hole 222 of tip 200 simultaneously. Now, the tip cannot be pulled longitudinally off the adapter.

Figure 5:
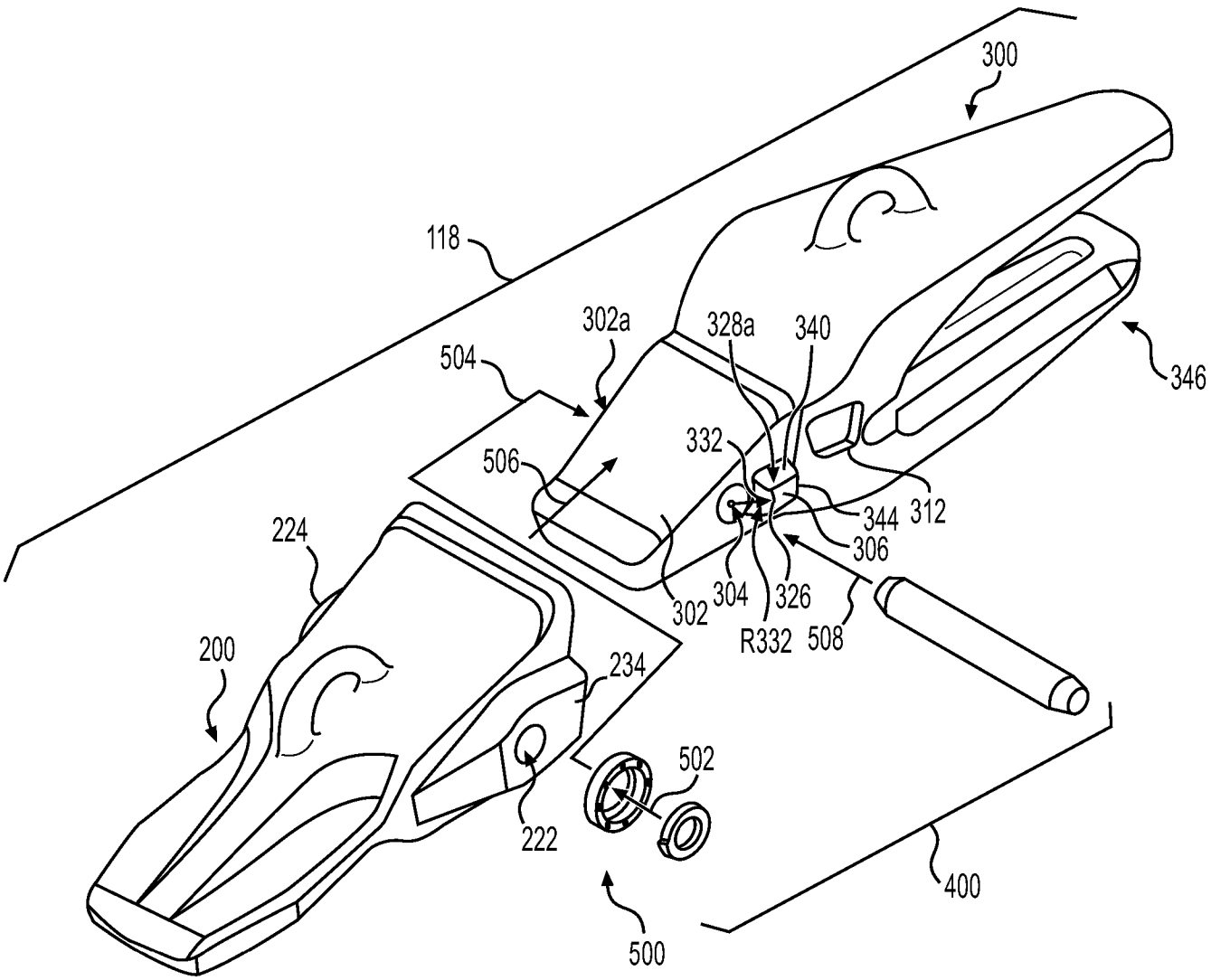
FIG. 5 is an exploded assembly view of the tip and adapter assembly of FIG. 2.

Turning now to FIGS. 3 thru 5, the first rail 306 may be disposed longitudinally adjacent to the aperture 304 of the adapter 300, forming a surface of revolution 326 (e.g., a conical or cylindrical surface, etc.) that is longitudinally adjacent to the aperture 304. Also, the first rail 306 may be interposed longitudinally between the aperture 304, and a throat portion 312 of the adapter 300.

In FIGS. 3 and 4, it can be seen that the first rail 306 may define a vertical width W306, a lateral height H306 that is less than the vertical width, and a longitudinal length L306 that is greater than the vertical width.

Figure 6:
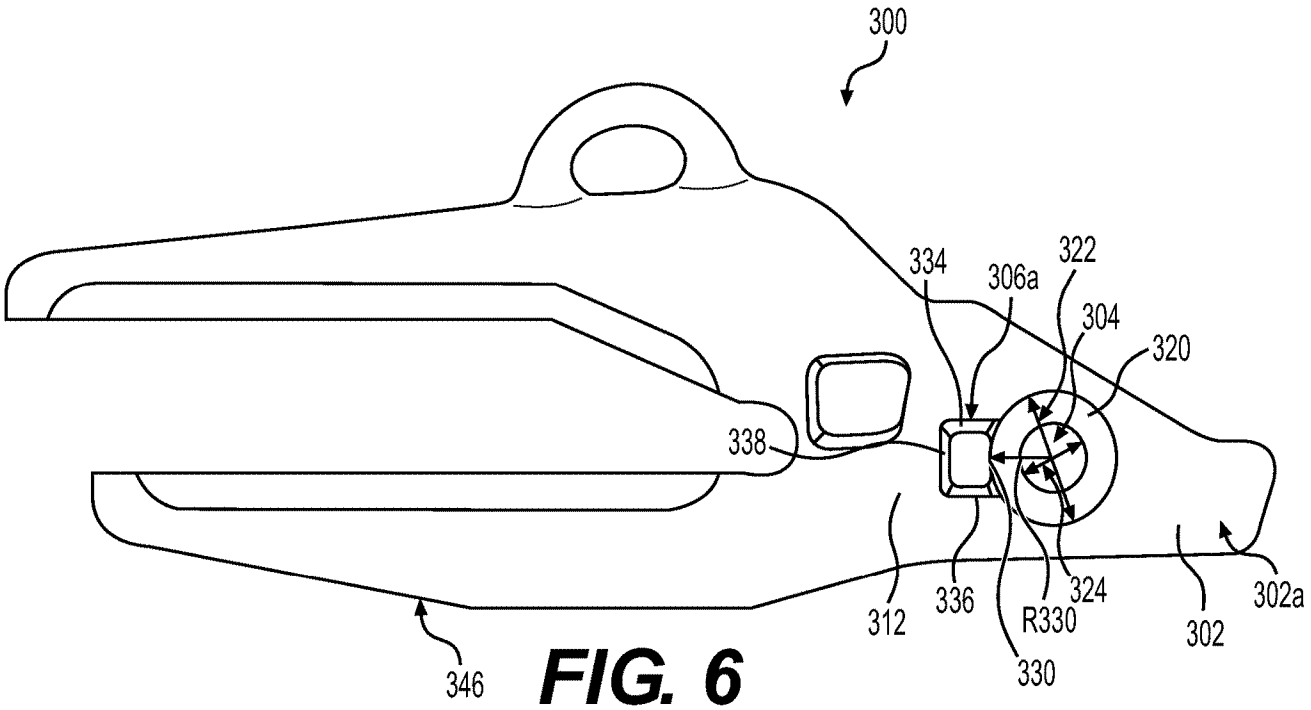
FIG. 6 is a side view of the adapter of FIG. 2 shown in isolation, revealing the counterbore that receives the retaining mechanism including the outer sleeve and the coil washer spring.
Figure 7:
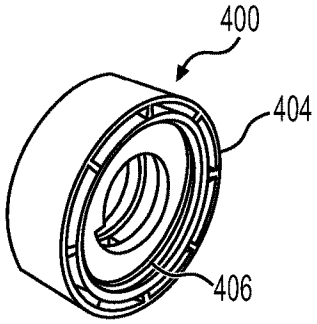
FIG. 7 depicts the outer sleeve and the coil washer spring assembled before being inserted into the counterbore of FIG. 6.

As seen in FIGS. 3 and 6, a second rail 328 may be provided that partially defines the counterbore 320, decreasing the longitudinal length L328 of the second rail 328 as compared to the longitudinal length L306 of the first rail 306. The width and the height may be the same.

A wear member that may be used to repair or retrofit an assembly similar or identical to assembly 118 will now be described with reference to FIGS. 4 and 5. The wear member (e.g., may take the form of tip 200, etc.) may comprise a shell body 201 defining a rear opening (e.g., see open end 214), forming an interior surface 218, and including an exterior surface 216 with a first ear 224 (two such ears may be provided, but not necessarily so), complementarily forming a rail receiving groove 220 (two such grooves may be provided but no necessarily so) on the interior surface 218 extending from the rear opening. A single hole 222 may extend through the first ear 224 to the rail receiving groove 220. As shown, the single hole 222 may maintain a constant diameter 226 (i.e. less than a 10% variance). This may not be the case for other embodiments of the present disclosure.

Next, a base member that may be used to repair or retrofit an assembly similar or identical to assembly 118 will now be described with reference to FIGS. 5 and 6.

Such a base (e.g., may take the form of adapter 300) may comprise a male portion 302*a* including a first projection 306*a*, and a second projection 328*a* facing in a diametrically opposed manner to the first projection 306*a*, as well as a stepped bore (e.g. may take the form of counterbore 320) that extends from the first projection 306*a* to the second projection 328*a*. As alluded to earlier herein, the stepped bore may include a large diameter portion 322 that is at least partially formed by the first projection 306*a*.

With continued reference to FIGS. 5 and 6, the first projection 306*a* may define a first concave arcuate surface 330 with a first radius of curvature R330, and the second projection 328*a* may define a second concave arcuate surface 332 with a second radius of curvature R332 that is less than the first radius of curvature R330 (or vice versa, meaning one rail is differently configured than the other rail having different radii of curvature). More specifically, a ratio of the first radius of curvature to the second radius of curvature may range from 1.72 to 2.08 in some embodiments of the present disclosure.

As best seen in FIG. 6, the first projection 306*a* may include a top planar surface 334, a bottom planar surface 336, and a rear planar surface 338 that is diametrically opposed or on the opposite side as compared to the first concave arcuate surface 330. Other configurations are possible.

Similarly, as best seen in FIGS. 4 and 5, the second projection 328*a* may include an upper planar surface 340, a lower planar surface 342, and a back planar surface 344 that is diametrically opposed or on the opposite side as compared to the second concave arcuate surface 332. Other configurations are possible in other embodiments of the present disclosure.

Referring once more to FIGS. 3, 5, and 6, the base may further comprise a female portion 346 (e.g., formed by the legs), and the first projection 306*a*, and the second projection 328*a* may be positioned between the stepped bore (e.g., counterbore 320), and the female portion 346. This may not be the case for other embodiments of the present disclosure (e.g., the projections may be in front of the stepped bore, etc.).

In FIG. 3, a retaining mechanism 400 may be disposed in the large diameter portion 322 of the stepped bore. More particularly, the sleeve 404 and the spring 406 are disposed in the counterbore 320. Also, the stepped bore also defines a small diameter portion 324 that extends from the large diameter portion 322 completely through the male portion 302*a*. This may not be the case in other embodiments of the present disclosure.

As a result of this structure, the pin 402 may be inserted into the stepped bore until it engages the spring (e.g., via a notch on its circumferential surface, via friction on its circumferential surface, etc.). To remove the pin, a tool may be placed on its end and tapped with a hammer until the pin moves out of the stepped bore. Now, the wear member may be removed from the base.

A tip and adapter assembly 118*a* similar to that of FIGS. 1 thru 7, will now be described with reference to FIGS. 8 thru 12. The main difference between assemblies 118, 118*a* is the counterbore for holding the retaining mechanism is placed in the tip for 118*a* instead of the adapter.

Figure 8:
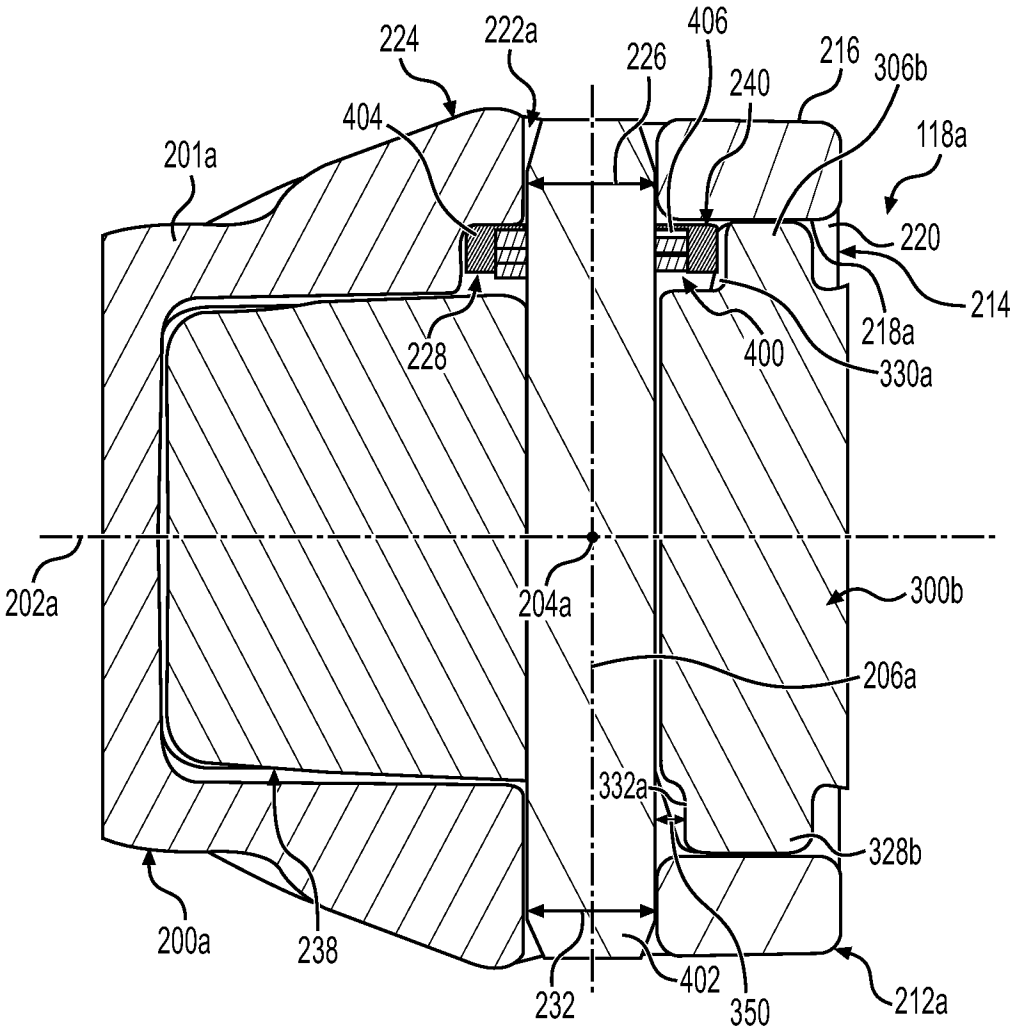
FIG. 8 is a partial sectional view of a tip and adapter assembly according to another embodiment of the present disclosure where the sleeve and spring of the retaining mechanism is held in place in an interior pocket of the tip.

For example, the adapter 300*b* shown in FIG. 8 is similarly constructed as the adapter 300 described earlier herein including having rails 306*b*, 328*b* or projections that are differently configured from each other and have similar shapes and sizes as those described earlier herein except that extra clearance 350 has been provided between the pin/retaining mechanism and the arcuate surfaces 330*a*, 332*a*. So, the ratio of their radii of curvature may still fall within the range described earlier herein. However, the counterbore is not present in the adapter 300*b*.

Figure 11:
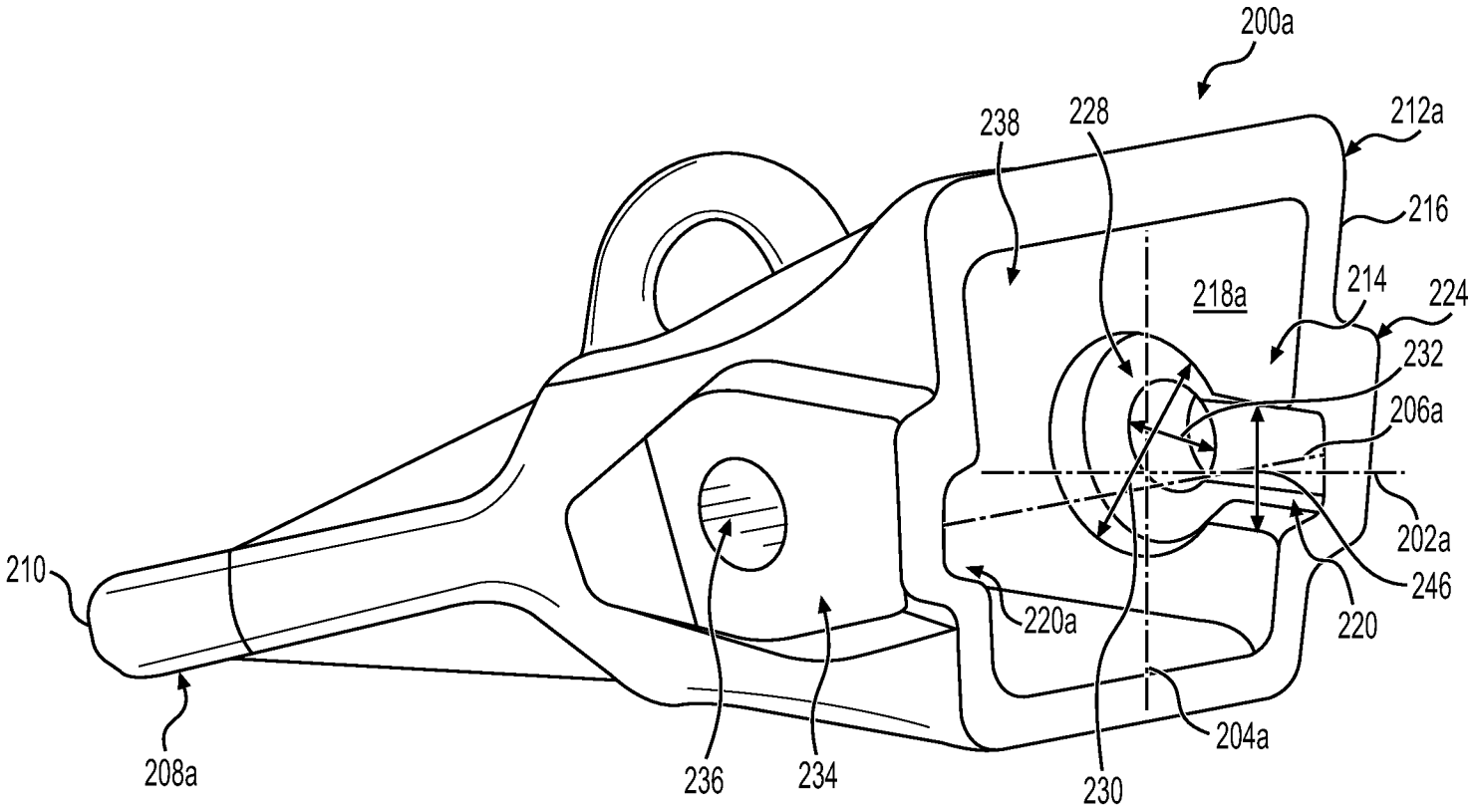
FIG. 11 is a rear oriented perspective view of the tip of FIG. 9 with the retaining mechanism removed, showing the pocket more clearly.
Figure 12:
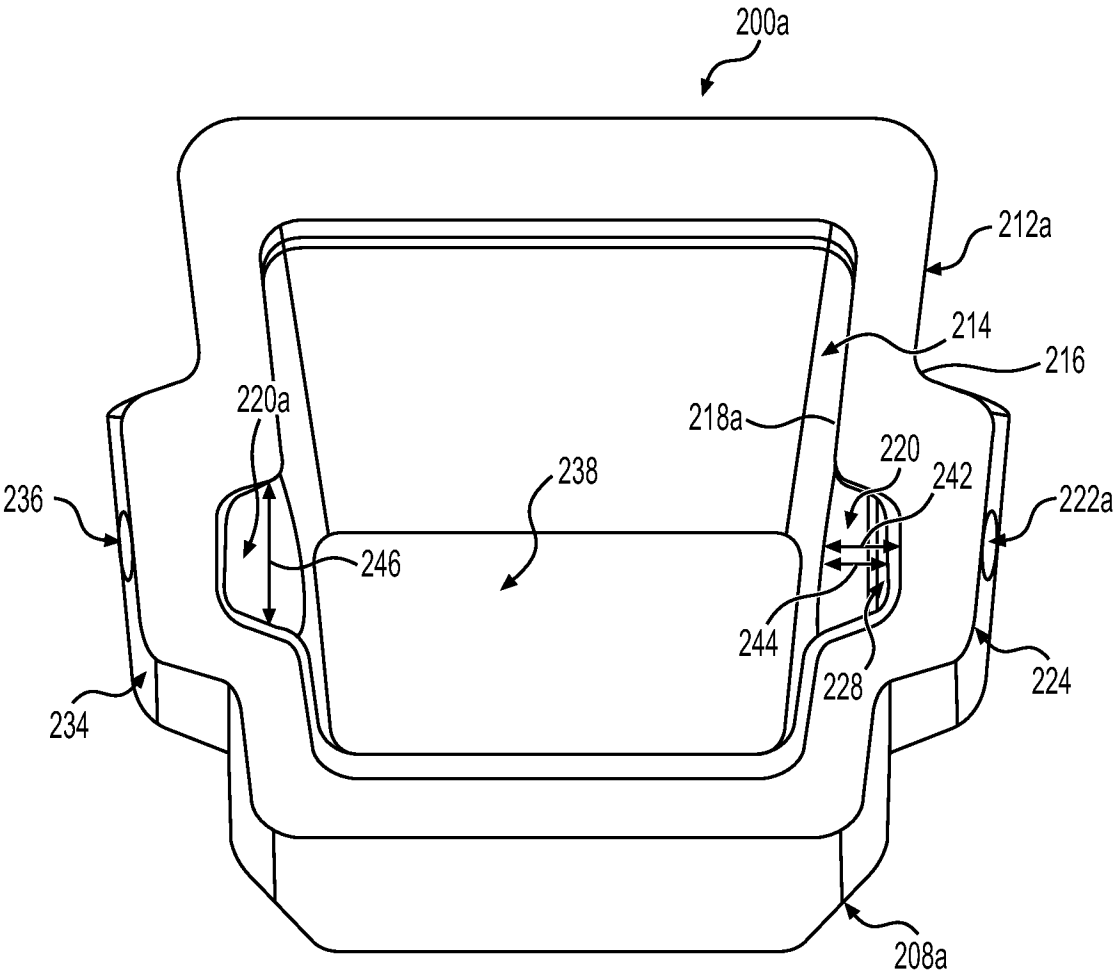
FIG. 12 is a rear view of the tip of FIG. 11.

Focusing now on the tip 200*a* as shown in FIGS. 11 and 12, it may have a body that defines a longitudinal axis 202*a*, a vertical axis 204*a* that is perpendicular to the longitudinal axis 202*a*, and a lateral axis 206*a* that is perpendicular to the longitudinal axis and the vertical axis. The body may include a forward working portion 208*a* that is disposed along the longitudinal axis 202*a* including a closed end 210, and a rear attachment portion 212*a* that is disposed along the longitudinal axis including an open end 214 with an exterior surface 216, and an interior surface 218*a*.

As best seen in FIG. 11, the interior surface 218*a* may define an interior counterbore 228 with a major diameter 230, and a minor diameter 232. A ratio of the major diameter to the minor diameter may range from 1.8 to 2.2. Also, the minor 232 diameter may extend laterally completely through the tip, but not necessarily so.

Figure 9:
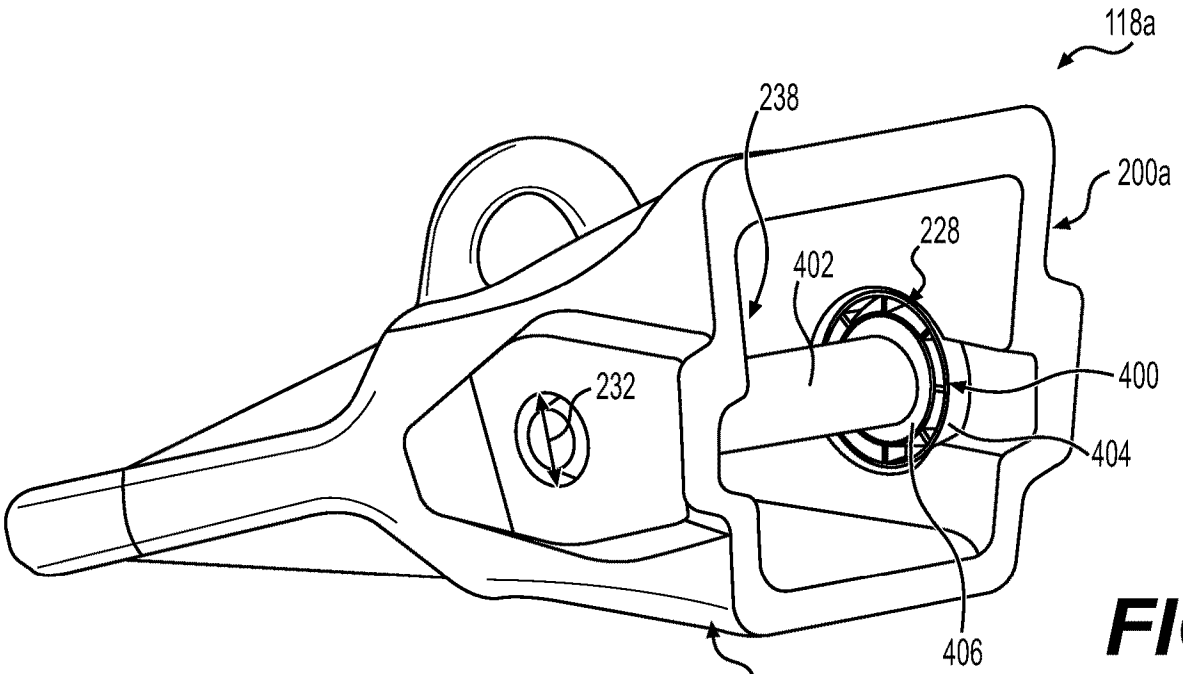
FIG. 9 is a rear oriented perspective view of the tip and the retaining mechanism of FIG. 8 with the adapter removed, allowing the pocket holding the sleeve and spring to be seen more clearly.
Figure 10:
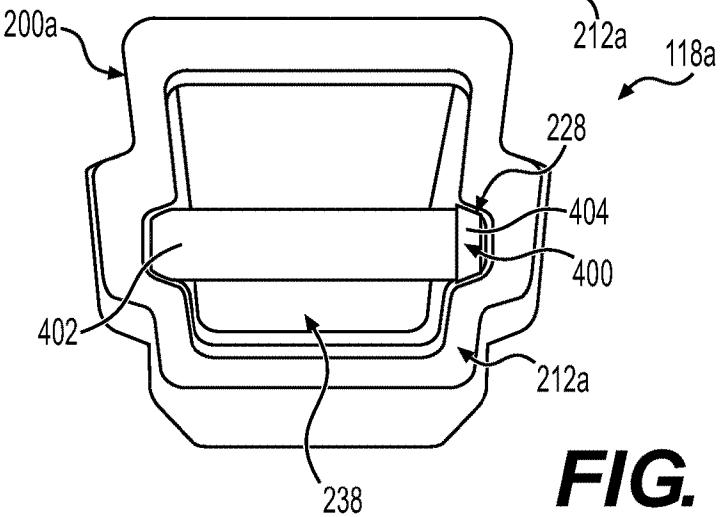
FIG. 10 is a rear view of the tip and the retaining mechanism of FIG. 9.

As shown in FIGS. 8 and 9, a retaining mechanism 400 may be is disposed in the interior counterbore 228 that includes a sleeve 404, and a spring 406 that is disposed in the interior counterbore 228 in a manner described elsewhere herein. In addition, a pin 402 may be disposed in the minor diameter 232 of the interior counterbore 228, and that engages the spring 406 in a manner described elsewhere herein.

Referring again to FIG. 11, the exterior surface 216 of the tip 200*a* may define a first ear 224, and the minor diameter 232 of the interior counterbore 228, may extend through the first ear 224. Also, the exterior surface 216 of the tip 200*a* may define a second ear 234, and another thru-hole 236 that is coextensive with the minor diameter 232 of the interior counterbore 228. Put another way, the minor diameter 232 may be constant (i.e., less than a 10% variance). This may not be the case for other embodiments of the present disclosure.

Looking solely from the exterior of the tip 200*a* (and also tip 200), it may be characterized in that the exterior surface 216 defines a single aperture (e.g., hole 222, 222*a*) that extends through the first ear, and another single aperture (e.g., thru-hole 236) that extends through the second ear 234. Both single apertures may be coextensive, etc.

Next, a wear member (e.g. tip 200, 200*a*) that may be supplied as a replacement part or as a retrofit in the field will be discussed with reference to FIGS. 3, 8 and 11.

The wear member may comprise a shell body 201, 201*a* defining a rear opening (e.g., open end 214), forming an interior surface 218, 218*a*, and including an exterior surface 216 with a first ear 224, complementarily forming a rail receiving groove 220 on the interior surface extending from the rear opening. A single hole 222, 222*a* may extend from the exterior surface 216 through the first ear 224 to the rail receiving groove 220, and defining a constant diameter 226.

Looking at FIGS. 3, 4 and 12, the exterior surface 216 defines a second ear 234, complimentarily forming another rail receiving groove 220*a* on the interior surface 218, 218*a* extending from the rear open end.

In FIG. 11, the interior surface 218*a* defines a counterbore (e.g., see 228) that is communication with the single hole 222 of the first ear 224 defining another constant diameter (e.g., may take the form of major diameter 230). A ratio of the constant diameter 230 of the counterbore to the constant diameter 226 of the single hole may range from 1.8 to 2.2.

A wear member according to another embodiment of the present disclosure may be described with reference to FIGS. 8 thru 12. The wear member (e.g., tip 200*a*) may comprise a nose receiving portion (e.g., may take the form of a rear attachment portion 212*a*) defining a nose receiving pocket 238, and an exterior (e.g., see exterior surface 216). An interior counterbore 228 may extend through the nose receiving portion from the nose receiving pocket 238 to the exterior surface 216. The interior counterbore 228 defines a large retaining mechanism receiving cavity 240 (see FIG. 8, large in the sense it is bigger than the small pin receiving hole 242) that is disposed adjacent to the nose receiving pocket 238, and a small pin receiving hole 242 (see FIG. 8) that extends from the exterior to the large retaining mechanism receiving cavity 240.

Also, a slot (e.g., may take the form of a rail receiving groove 220) that extends from the exterior toward the large retaining mechanism receiving pocket 240. As shown in FIGS. 8 and 11, the slot may extend completely to the large retaining mechanism receiving cavity 240, but not necessarily so. Thus, the slot, the counterbore, and the nose receiving pocket are all in communication with each other.

As best seen in FIG. 12, the slot may define a slot depth 242 (measured laterally), while the large retaining mechanism receiving cavity 240 defines a cavity depth 244 that is less than the slot depth 242. This may not be the case in other embodiments of the present disclosure.

Moreover, the slot may define a slot width 246 (measured vertically), and the large retaining mechanism receiving cavity 240 defines a diameter (e.g., major diameter 230 in FIG. 11) that is greater than the slot width 246. Again, this may not be the case in other embodiments of the present disclosure. The retaining mechanism 400 (e.g., the sleeve 404, and the spring 406) may be disposed in the large retaining mechanism receiving cavity 240.

Again, it should be noted that any of the dimensions, angles, surface areas and/or configurations of various features may be varied as desired or needed including those not specifically mentioned herein. Although not specifically discussed, blends such as fillets are shown to connect the various surfaces. These may be omitted in other embodiments and it is to be understood that their presence may be ignored sometimes when reading the present specification unless specifically mentioned.

INDUSTRIAL APPLICABILITY

In practice, a machine, a work implement assembly, a tip, a wear member, an adapter, a base member, an adapter assembly, a tip and adapter assembly, a retaining mechanism, and/or any combination of these various assemblies and components may be manufactured, bought, or sold to retrofit a machine or a work implement assembly in the field in an aftermarket context, or alternatively, may be manufactured, bought, sold or otherwise obtained in an OEM (original equipment manufacturer) context.

Any of the aforementioned components may be made from any suitable material including iron, grey-cast iron, steel, spring steel, plastic, rubber, foam, etc.

The aforementioned tip and adapter assembly, etc. as shown in FIGS. 1 thru 4 may be assembled using method 500 as illustrated in FIG. 5. First, the spring may be inserted (e.g., snapped into or screwed into) the sleeve (see step 502). Second, this subassembly (as shown for example in FIG. 7) is inserted into the counterbore (see step 504). Then, the tip is slid onto the adapter (step 506). After that, the pin is placed into the counterbore from either side, and tapped with a hammer until the pin engages the spring as alluded to earlier herein (step 508). Now, the tip is secured to the adapter. Disassembly may be achieved by reversing one or more of these steps.

For the tip and adapter assembly shown in FIGS. 8 thru 12, the assembly process is substantially the same except the sleeve/spring subassembly would be inserted into the counterbore of the tip. Then, disassembly would be achieved by reversing one or more steps of assembly.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An assembly comprising:

an adapter including a body that defines a longitudinal axis, a vertical axis that is perpendicular to the longitudinal axis, and a lateral axis that is perpendicular to the longitudinal axis and the vertical axis, and has a nose portion including an aperture, a first rail disposed adjacent the aperture along the longitudinal axis and a second rail, wherein the first rail and the second rail each comprise a single projection, wherein the aperture of the nose portion is a counterbore with a large diameter portion and a small diameter portion;

a wear member having an opening configured to receive the nose portion, the wear member including a first ear on a first side thereof and a second ear on a second opposing side thereof, wherein the first ear forms a first groove configured to receive the first rail therein, wherein the first ear has a thru hole therein, wherein the second ear forms a second groove configured to receive the second rail therein, and wherein the second ear has a thru hole therein;

a retaining mechanism including a sleeve and a spring that are disposed in the large diameter portion of the counterbore; and a pin received by the thru hole of the first ear and by thru hole in the second ear and extending through the aperture of the nose portion, wherein the pin engages the spring, being disposed in the large diameter portion of the counterbore, and the small diameter portion of the counterbore;

wherein the first rail partially defines the large diameter portion of the counterbore and is engaged by the sleeve, wherein the first rail has a decreased longitudinal length as compared to a longitudinal length of the second rail;

wherein the first rail and the second rail are projections on opposing sides of the nose portion that extend laterally and vertically from the nose portion and are received in the first groove and the second groove, respectively.

2. The assembly of claim 1, wherein the adapter includes a first leg, a second leg, and a throat portion that connects the first leg to the second leg, forming a slot with an open end and a closed end.

3. The assembly of claim 1, wherein the first rail is disposed longitudinally adjacent to the aperture, forming a surface of revolution that is longitudinally adjacent to the aperture.

4. The assembly of claim 3, wherein the first rail is interposed longitudinally between the aperture and a throat portion of the adapter.

5. The assembly of claim 3, wherein the first rail defines a vertical width, a lateral height that is less than the vertical width, and a longitudinal length that is greater than the vertical width.

6. An assembly comprising:

an adapter comprising:

a nose portion that defines an aperture, the nose portion is part of a body that defines a longitudinal axis, a vertical axis that is perpendicular to the longitudinal axis, and a lateral axis that is perpendicular to the longitudinal axis and the vertical axis;

a first rail extending as a first projection from the nose portion that is disposed adjacent to and forms a portion of a first end of the aperture; and a second rail extending as a second projection from an opposing side of the nose portion from the first rail, wherein the second rail is disposed adjacent to a second end of the aperture;

wherein the first rail is differently configured than the second rail having at least a different longitudinal extent therefrom, a wear member having an opening configured to receive the nose portion, the wear member including a first ear on a first side thereof and a second ear on a second opposing side thereof, wherein the first ear forms a first groove configured to receive the first rail therein, wherein the first ear has a thru hole therein, wherein the second ear forms a second groove configured to receive the second rail therein, and wherein the second ear has a thru hole therein;

a retaining mechanism including a sleeve and a spring; and a pin received by the thru hole of the first ear and by thru hole in the second ear and extending through the aperture of the nose portion, wherein the pin engages the spring;

wherein the wear member is symmetrically shaped with regard to a configuration of the first ear and the second ear but the adapter has the first rail that is differently configured than the second rail.

7. The assembly of claim 6, wherein the first rail defines a first concave arcuate surface that has a first radius of curvature, and the second rail has a second concave arcuate surface with a second radius of curvature that is different than the first radius of curvature.

8. An assembly comprising:

a base comprising:

a male portion that defines a longitudinal axis, a vertical axis that is perpendicular to the longitudinal axis, and a lateral axis that is perpendicular to the longitudinal axis and the vertical axis, and including:

a first projection and a second projection arranged on opposing faces of the male portion from one another, wherein the first projection is differently configured than the second projection having at least a different longitudinal extent therefrom; and a stepped bore that extends from the first projection to the second projection;

wherein the stepped bore includes a large diameter portion that is at least partially formed by the first projection;

a wear member having an opening configured to receive the male portion, the wear member including a first ear on a first side thereof and a second ear on a second opposing side thereof, wherein the first ear forms a first groove configured to receive the first projection therein, wherein the first ear has a thru hole therein, wherein the second ear forms a second groove configured to receive the second projection therein, and wherein the second ear has a thru hole therein:

a retaining mechanism including a sleeve and a spring, wherein the retaining mechanism is disposed in the large diameter portion of the stepped bore, and the stepped bore also defines a small diameter portion that extends from the large diameter portion completely through the male portion; and a pin received by the thru hole of the first ear and by thru hole in the second ear and extending through the stepped bore of the base, wherein the pin engages the spring, being disposed in the large diameter portion, and the small diameter portion.

9. The assembly of claim 8, wherein the first projection defines a first concave arcuate surface with a first radius of curvature, and the second projection defines a second concave arcuate surface with a second radius of curvature that is less than the first radius of curvature.

10. The assembly of claim 9, wherein a ratio of the first radius of curvature to the second radius of curvature ranges from 1.72 to 2.08.

11. The assembly of claim 9, wherein the first projection includes a top planar surface, a bottom planar surface, and a rear planar surface that is diametrically opposed to the first concave arcuate surface.

12. The assembly of claim 11, wherein the second projection includes an upper planar surface, a lower planar surface, and a back planar surface that is diametrically opposed to the second concave arcuate surface.

13. The assembly of claim 8, further comprising a female portion, and the first projection, and the second projection are positioned between the stepped bore, and the female portion.

14. The assembly of claim 8, wherein the retaining mechanism includes a sleeve and a spring disposed in the sleeve.

15. The assembly of claim 1, wherein the pin has a substantially uniform cross-section along a middle section thereof that is engaged by the spring and immediately adjacent thereto.

16. The assembly of claim 1, wherein the sleeve has a hub and spoke shape and forms a receptacle configured to receive the spring.

* * * * *